US010667050B2

(12) United States Patent
Moritoki et al.

(10) Patent No.: US 10,667,050 B2
(45) Date of Patent: May 26, 2020

(54) AUDIO CIRCUIT

(71) Applicant: ROHM CO., LTD., Kyoto-shi, Kyoto (JP)

(72) Inventors: Kenichi Moritoki, Kyoto (JP); Mitsuaki Sakamoto, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 16/118,964

(22) Filed: Aug. 31, 2018

(65) Prior Publication Data

US 2019/0141446 A1 May 9, 2019

(30) Foreign Application Priority Data

Aug. 31, 2017 (JP) ..... 2017-167042

(51) Int. Cl.

| | |
|---|---|
| ***H04R 3/00*** | (2006.01) |
| ***H04R 3/08*** | (2006.01) |
| ***H04R 29/00*** | (2006.01) |

(52) U.S. Cl.
CPC ..... *H04R 3/007* (2013.01); *H04R 3/08* (2013.01); *H04R 29/001* (2013.01); *H04R 2499/13* (2013.01)

(58) Field of Classification Search
CPC ... H04R 3/007; H04R 29/001; H04R 2499/13
USPC ..... 381/55
See application file for complete search history.

(56) References Cited

U.S. PATENT DOCUMENTS 5,729,611 A * 3/1998 Bonneville ..... H03F 1/52 381/55
2015/0304772 A1* 10/2015 Risberg ..... H04R 3/007 381/55

FOREIGN PATENT DOCUMENTS

JP 2002112400 A 4/2002

* cited by examiner

*Primary Examiner* — David L Ton
(74) *Attorney, Agent, or Firm* — Cantor Colburn LLP

(57) ABSTRACT

An audio circuit drives a speaker. A DSP corrects an audio signal S1 according to the state of the speaker. An amplifier drives the speaker according to a corrected audio signal S3.

9 Claims, 4 Drawing Sheets

AUDIO CIRCUIT

CROSS-REFERENCE TO RELATED APPLICATION

The present application claims priority under 35 U.S.C. § 119 to Japanese Patent Application No. 2017-167042, filed on Aug. 31, 2017, the entire contents of which are incorporated herein by reference.

BACKGROUND OF THE INVENTION

1. Field of the Invention

The present invention relates to an audio circuit.

2. Description of the Related Art

In-vehicle audio apparatuses (car audio apparatuses) or home audio apparatuses are provided with multiple speakers arranged at different positions. In order to support high-quality audio reproduction operation, such multiple channels preferably have uniform characteristics.

In recent years, accompanying advances in digital signal processing techniques, it has become possible to support correction processing to provide multiple channels with uniform characteristics. Specifically, a known audio signal (reference signal) is reproduced. The audio signal thus reproduced is acquired by means of a microphone. The audio signal thus acquired is analyzed by signal processing so as to correct the audio signal output from each channel such that the multiple channels are each provided with uniform frequency characteristics (equalizing).

Furthermore, in time alignment processing, different delays are applied to multiple respective channels so as to cancel out the difference in distance between the viewing/listening position and multiple speakers.

With conventional correction processing, this arrangement is capable of correcting variation in characteristics due to static factors such as the speaker installation positions, the kinds of speakers, or the like. However, it is difficult for such an arrangement to correct variation in characteristics due to dynamic factors such as vibration applied to the speakers, temperature variation, aging degradation of the speakers, or the like.

SUMMARY OF THE INVENTION

The present invention has been made in order to solve such a problem. Accordingly, it is an exemplary purpose of an embodiment of the present invention to provide an audio circuit that is capable of providing improved sound quality.

An embodiment of the present invention relates to an audio circuit structured to drive a speaker. The audio circuit comprises: a signal processing unit structured to correct an audio signal according to a state of the speaker; and an amplifier structured to drive the speaker according the corrected audio signal.

With this embodiment, this arrangement is capable of monitoring the state of the speaker that changes with time, and of dynamically and adaptively correcting the reproduction characteristics based on the monitoring results. Accordingly, this arrangement provides improved sound quality.

Also, the audio circuit may further comprise at least one sensor structured to detect the state of the speaker.

Examples of the state of the speaker include vibration of the speaker housing, the temperature, the magnetic field, and the impedance.

Also, at least one sensor may be a vibration sensor structured to detect the vibration of the speaker. Also, the signal processing unit may superimpose, on the audio signal, a signal having opposite phase to the vibration.

When vibration (which is referred to as "disturbance vibration") occurs in the housing of the speaker itself in a direction that is orthogonal to the face of the vibration plate, this is equivalent to an operation as if the vibration plate were driven due to the disturbance vibration. This leads to degradation in the sound quality. With this embodiment, by vibrating the vibration plate with a phase that is the opposite of that of the disturbance vibration, this arrangement is capable of canceling out the effects of the disturbance vibration, thereby providing improved sound quality.

Also, at least one sensor may be a magnetic sensor structured to detect the magnetic field generated by the speaker. There is a difference in the magnetic field generated by the magnet between the speakers. Furthermore, the magnetic field varies due to aging degradation. With a multi-channel audio system, such a difference in the magnetic field between the speakers manifests as a difference in the output between the multiple speakers, which is a cause of degraded sound quality. In order to solve such a problem, by correcting the audio signal for each channel according to the magnetic field, this arrangement is capable of suppressing such a difference between the channels, thereby providing improved sound quality.

Also, at least one sensor may be a temperature sensor structured to detect the temperature of the speaker. With a multi-channel audio system, a difference in the temperature between the speakers manifests as a difference in the output between the multiple speakers, which becomes a cause of degraded sound quality. In order to solve such a problem, by correcting the audio signal for each channel according to the temperature, this arrangement is capable of suppressing such a difference between channels, thereby providing improved sound quality.

When the temperature is high, the signal processing unit may superimpose a low-frequency component outside the audible band on the audio signal. This arrangement is capable of cooling the speaker by means of aerodynamic effects.

Also, the audio circuit may comprise a detection circuit structured to measure the current that flows through the speaker. The sound pressure generated by the speaker changes according to the impedance thereof even if the speaker is driven with the same driving voltage. Accordingly, by calculating the impedance based on the current that flows through the speaker, this arrangement is capable of correcting the sound pressure.

Also, multiple speakers and multiple audio circuits may be used as a set. Also, correction for each audio circuit may be controlled such that output characteristics become uniform between the multiple speakers.

Another embodiment of the present invention relates to a speaker unit. The speaker unit comprises a speaker and the above-described audio circuit structured to drive the speaker. The speaker and the audio circuit are monolithically integrated.

The speaker unit may further comprise nonvolatile memory structured to store predetermined audio data. The signal processing unit may be capable of reproducing the audio data.

It is to be noted that any arbitrary combination or rearrangement of the above-described structural components and so forth is effective as and encompassed by the present embodiments. Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is coupled to the member B" includes a state in which the member A is indirectly coupled to the member B via another member that does not substantially affect the electric connection between them, or that does not damage the functions of the connection between them, in addition to a state in which they are physically and directly coupled.

Similarly, the state represented by the phrase "the member C is provided between the member A and the member B" includes a state in which the member A is indirectly coupled to the member C, or the member B is indirectly coupled to the member C via another member that does not substantially affect the electric connection between them, or that does not damage the functions of the connection between them, in addition to a state in which they are directly coupled.

Figure 1:
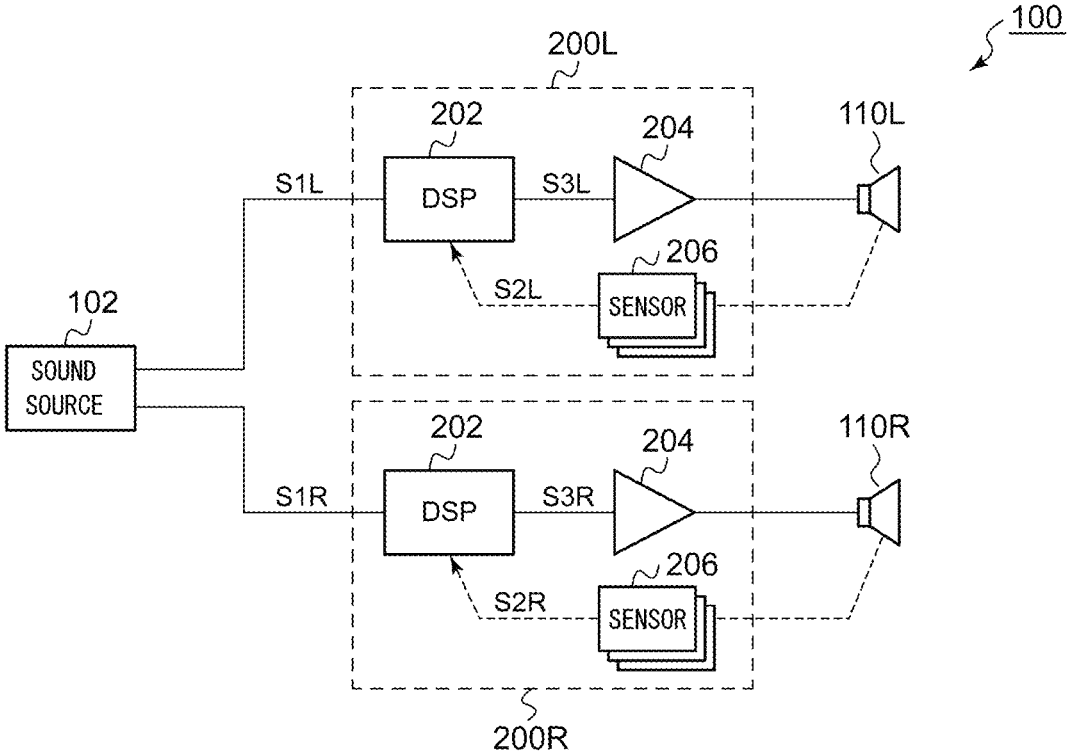
FIG. 1 is a block diagram showing an audio system according to an embodiment.

FIG. 1 is a block diagram showing an audio system 100 according to an embodiment. The audio system 100 is configured to have multiple channels. For simplification of description, description will be made in the present embodiment regarding an arrangement having two channels. However, the number of channels is not restricted in particular. Also, the audio system 100 may be configured as a four-channel system, 3.1-channel system, 5.1-channel system, 7.1-channel system, or the like.

An audio system 100 includes a sound source 102, multiple speakers 110, and multiple audio circuits 200. The speaker 110 and the audio circuit 200 are provided for each channel.

The sound source 102 reproduces an audio signal. With an in-vehicle audio apparatus, the sound source 102 is also referred to as the "head unit". The audio signals S1L and S1R for the respective channels are input to the respective audio circuits 200L and 200R. The audio signal S1 may be configured as a digital signal or otherwise an analog signal.

Each audio circuit 200 receives the corresponding audio signal S1, and drives the corresponding speaker 110. The above is the overall configuration of the audio system 100. Next, description will be made regarding the audio circuit 200. The audio circuit 200 for each channel has the same configuration. Accordingly, in the following description, appended suffixes L and R for indicating the channels will be omitted.

The audio circuit 200 includes a DSP (digital signal processing unit) 202 and an amplifier 204. The DSP 202 performs various kinds of signal processing on the audio signal S1. For example, various kinds of functions are implemented in the DSP 202 so as to function as a digital volume control, multi-band equalizer, parametric equalizer, loudness circuit, etc.

The DSP 202 includes a communication interface that supports communication with the sound source 102, which allows the DSP 202 to receive control data in addition to the audio signal S1. Examples of such control data include setting values for a volume control or equalizer, and the like. However, the present invention is not restricted to such an example.

The DSP 202 receives a detection signal S2 as an input signal that indicates the state of the corresponding speaker 110. The DSP 202 corrects the audio signal S1 according to the state of the speaker 110 indicated by the detection signal S2. The state to be monitored and the correction will be described later.

The amplifier 204 drives the speaker 110 according to a corrected audio signal S3. The amplifier 204 may be configured as a class D amplifier (digital amplifier). Also, the amplifier 204 may be configured as a class A or class AB analog amplifier (linear amplifier). In a case in which the amplifier 204 is configured as an analog amplifier, a D/A converter is provided between the DSP 202 and the amplifier 204. In a case in which the amplifier 204 is configured as a digital amplifier, a combination of the amplifier 204 and an unshown analog filter functions as a D/A converter.

The audio circuit 200 may include at least one sensor 206 that detects the state of the speaker 110.

The above is the configuration of the audio system 100. Next, description will be made regarding the advantage thereof.

The states of the multiple speakers 110L and 110R change with time, leading to a change in reproduction characteristics. If a difference occurs in the reproduction characteristics of the multiple channels, this leads to degradation in the sound quality. With the audio system 100 shown in FIG. 1, the audio circuit 200 is capable of monitoring the state of the speaker 110, and dynamically and adaptively correcting the reproduction characteristics based on the monitored results.

The reproduction characteristics may relatively be corrected between the multiple channels. In this case, the data that indicates the states of all the channels may be collected in the head unit (sound source 102) that controls the overall operation for all the channels. The head unit may determine a correction value for each channel. The DSP 202 in each channel may correct the reproduction characteristics based on the correction value received from the head unit.

The reproduction characteristics may also be corrected independently for each channel in an absolute manner. In the correction in such an absolute manner, a common reference value may be determined for all the channels. In each channel, the corresponding DSP 202 may correct the reproduction characteristics based on the reference value.

Figure 2:
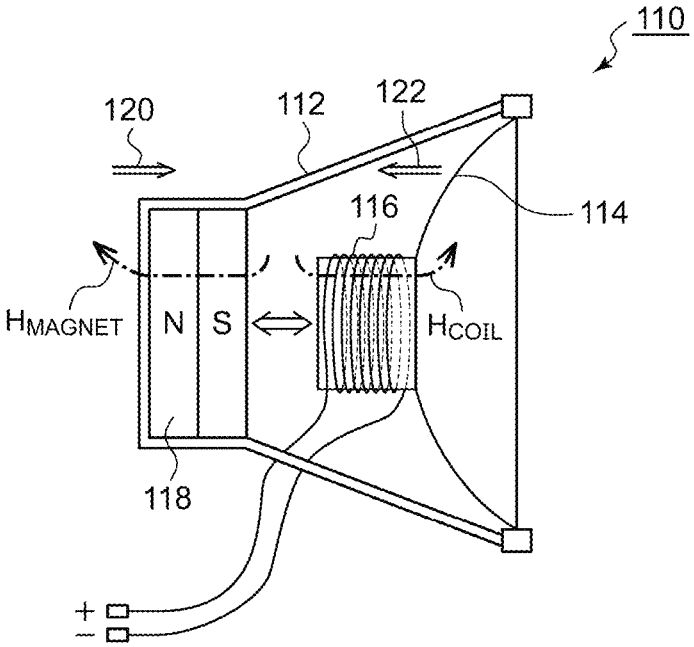
FIG. 2 is a block diagram showing a configuration of a speaker.

Next, specific description will be made with reference to FIG. 2 regarding the state of the speaker 110 to be monitored and the correction. FIG. 2 is a block diagram showing a configuration of the speaker 110. It should be noted that the configuration of the speaker 110 is shown for exemplary purposes only. Also, the present invention is applicable to a speaker having another known configuration. The speaker 110 includes a housing 112, a vibration plate 114, a coil 116, and a magnet 118. A driving voltage is supplied from the amplifier to terminals (+, −) drawn from both ends of the coil 116. When an AC driving voltage $V_{DRV}$ is applied to the coil 116, a coil magnetic field $H_{COIL}$ is generated in a direction that is orthogonal to the vibration plate 114. The coil magnetic field $H_{COIL}$ interacts with the magnetic field $H_{MAGNET}$ that occurs due to the magnet 118, which vibrates the vibration plate 114. As a result, the electric signal is converted into an acoustic signal.

Vibration of Speaker

One of the states of the speaker 110 to be monitored is the vibration of the speaker 110.

The housing 112 of the speaker 110 is fixedly mounted on an unshown cabinet. In the in-vehicle audio apparatus, a door functions as a cabinet. If vibration occurs in the cabinet, the vibration propagates to the vibration plate 114 via the housing 112. When the speaker 110 as a whole vibrates (due to disturbance) in a direction that is orthogonal to the face of the vibration plate 114, this is equivalent to an operation as if the vibration plate 114 were driven due to the disturbance vibration 120. This leads to degradation in the sound quality.

In order to solve such a problem, with an embodiment, disturbance vibration 120 may preferably be detected by means of the sensor 206, and a correction signal may preferably be superimposed on the driving voltage $V_{DRV}$ to be applied to the coil 116 so as to cancel out the effects of the disturbance vibration 120. Specifically, the correction signal may preferably be generated so as to induce correction vibration 122 in the vibration plate 114 with an opposite phase (opposite polarity) that is opposite to the disturbance vibration 120. This correction can be provided in the reproduction operation for the audio signal.

Magnetic Field of Speaker

There is a difference in the magnetic field $H_{MAGNET}$ generated by the magnet 118 between the speakers 110. Furthermore, the magnetic field $H_{MAGNET}$ varies due to aging degradation. With a multi-channel audio system, such a difference in the magnetic field $H_{MAGNET}$ between speakers 110 manifests as a difference in the output between the multiple speakers, which is a cause of degraded sound quality. In order to solve such a problem, the magnetic field $H_{MAGNET}$ due to each magnet 118 is measured, and the magnitude of the coil magnetic field $H_{COIL}$ is corrected, i.e., the driving voltage $V_{DRV}$ is corrected, so as to cancel out the difference in the magnitude of the magnetic field $H_{MAGNET}$. This arrangement is capable of suppressing the difference between the channels, thereby providing improved sound quality. Specifically, the audio signal may be multiplied by a correction coefficient (gain) determined based on the difference in the magnetic field $H_{MAGNET}$, so as to change the amplitude of the driving voltage $V_{DRV}$.

Temperature of Speaker

The reproduction characteristics of each speaker 110 change due to temperature T. The temperature T affects the inductance of the coil 116. Alternatively, the temperature T can affect the mechanical characteristics (rigidity, etc.) of the vibration plate 114. Accordingly, with a multi-channel audio system, a difference in the temperature T between the speakers 110 manifests as a difference in the acoustic output between the multiple speakers 110, which becomes a cause of degraded sound quality. In order to solve such a problem, by correcting the audio signal for each channel according to the temperature T, this arrangement is capable of suppressing such a difference between channels, thereby providing improved sound quality.

Also, the speakers 110 may be cooled by means of aerodynamic effects by driving the speakers 110 with a low frequency (20 Hz or less) outside the audio band, so as to solve the original problem of the difference in temperature between the speakers 110. Specifically, when the temperature T exceeds a given threshold value, or otherwise when the difference in the temperature between the channels exceeds a given threshold value, a cooling correction component having a frequency component of 20 Hz or less may be superimposed on the audio signal for the channel that exhibits the high temperature.

Impedance of Speaker

The reproduction characteristics of each speaker 110 can be estimated by measuring the impedance Z thereof. Accordingly, the impedance Z of each speaker 110 may be measured, and the amplitude of the driving voltage $V_{DRV}$ and the frequency characteristics thereof may be corrected according to the impedance Z. As the impedance Z, a DC impedance may be employed. Also, at least one AC impedance for a given frequency may be employed as the impedance Z.

Next, description will be made regarding a specific example configuration of the audio system 100.

Figure 3:
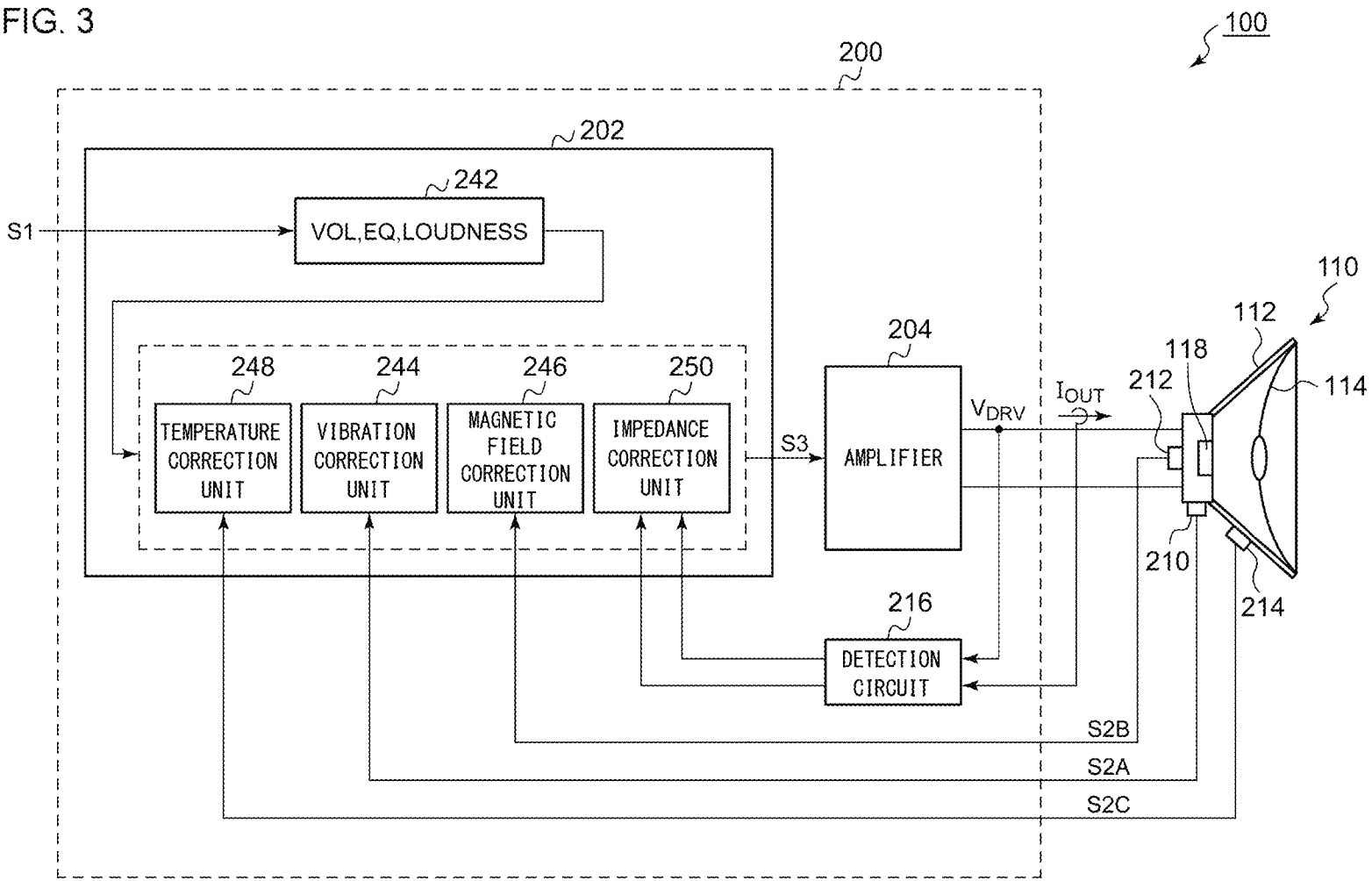
FIG. 3 is a block diagram showing an audio system according to an embodiment.

FIG. 3 is a block diagram showing the audio system 100 according to an embodiment. FIG. 2 shows only a one-channel configuration. As the sensor 206 shown in FIG. 1, the audio system 100 includes a vibration sensor 210, a magnetic sensor 212, and a temperature sensor 214.

Furthermore, the DSP 202 includes an audio processing unit 242, a vibration correction unit 244, a magnetic field correction unit 246, a temperature correction unit 248, and an impedance correction unit 250. Such circuit blocks may each be configured as a software component or a hardware component. The audio processing unit 242 supports processing relating to audio reproduction such as digital volume processing, equalizing processing, loudness processing, etc. The correction units from the vibration correction unit 244 up to the impedance correction unit 250 each correct an audio signal based on the speaker state after (or otherwise before) the audio signal is processed by the audio processing unit 242. It should be noted that, in a case in which the amplitude of the audio signal S3 is corrected based on the speaker state, this arrangement may use a function of a digital volume control circuit included in the audio processing unit 242. In a case in which the frequency characteristics of the audio signal S3 are corrected, this arrangement may use a function of a digital filter (multiband equalizer) included in the audio processing unit 242.

Correction of Vibration

The vibration sensor 210 detects disturbance vibration 120 that occurs in the housing 112 of the speaker 110, and generates a detection signal S2A. The vibration correction unit 244 of the DSP 202 detects the disturbance vibration 120 based on the detection signal S2A received from the vibration sensor 210. Furthermore, the vibration correction unit 244 generates a correction signal having an opposite phase of that of the disturbance vibration 120. By superimposing the correction signal on the audio signal S3, the effects of the disturbance vibration are canceled out, thereby providing improved sound quality.

As the vibration sensor 210, an acceleration sensor may be employed. In this case, the DSP 202 may execute double integration of the detection signal S2A so as to convert it into displacement information. Also, the DSP 202 may generate the correction signal according to the displacement information. The vibration may be corrected independently for each channel.

Correction of Magnetic Field

The magnetic sensor 212 detects the magnitude of the magnetic field $H_{MAGNET}$ generated due to the magnet 118 of the speaker 110, and generates a detection signal S2B that indicates the magnetic field $H_{MAGNET}$. A magnetic field correction unit 246 of the DSP 202 determines a correction gain based on the detection signal S2B generated in a non-reproduction state (mute state) of the audio signal.

For example, when the magnetic field $H_{MAGNET}$ thus measured is small, the amplitude of the audio signal S3 may preferably be raised so as to raise the magnetic field $H_{COIL}$ generated by the coil 116. Conversely, when the magnetic field $H_{MAGNET}$ thus measured is large, the amplitude of the audio signal S3 may preferably be reduced so as to reduce the magnetic field $H_{COIL}$ generated by the coil 116.

The magnetic field may be corrected relatively for the multiple channels. In the correction, the channel at which the smallest magnetic field has occurred may be employed as a reference channel. Also, the channel at which the largest magnetic field has occurred may be employed as such a reference channel. As described above, the sound source 102 shown in FIG. 1 may determine the parameter (correction gain) to be used for relative correction.

Alternatively, the magnetic field may be corrected independently for each channel with respect to a common reference value.

Correction of Temperature

The temperature sensor 214 measures the temperature of the speaker 110. A temperature correction unit 248 of the DSP 202 corrects the amplitude or the frequency characteristics of the audio signal S3 based on a detection signal S2C that indicates the temperature. For example, when the temperature T thus measured is high, the temperature correction unit 248 of the DSP 202 may preferably raise the amplitude of the audio signal S3 so as to raise the magnetic field $H_{COIL}$ generated by the coil 116.

Conversely, when the temperature T is low, the DSP 202 may preferably reduce the amplitude of the audio signal S3 so as to reduce the magnetic field $H_{COIL}$ generated by the coil 116. In a case in which an increase in the temperature T affects only a particular frequency component, the DSP 202 may preferably correct the gain for that particular frequency component.

The effects of the temperature may be corrected relatively for the multiple channels, or otherwise, may be corrected for each channel in an absolute manner, as with the correction of the magnetic field.

Also, when the temperature T is high, the DSP 202 may superimpose a cooling correction signal having a low frequency component (20 Hz or less) outside the audio band on the audio signal S3, so as to cool the speaker 110 by means of aerodynamic effects. Each speaker may be cooled in the reproduction operation for the audio signal.

Correction of Impedance

The detection circuit 216 detects a current $I_{OUT}$ that flows through the speaker 110 in order to correct the impedance of the speaker 110. The impedance correction unit 250 of the DSP 202 corrects the gain according to the impedance Z calculated based on the current $I_{OUT}$ and the driving voltage $V_{DRV}$. As the driving voltage $V_{DRV}$, a measurement value may be employed, or otherwise a theoretical value may be employed. In a case in which a measurement value is employed as the driving voltage $V_{DRV}$, the detection circuit 216 may preferably be configured to be capable of detecting the driving voltage $V_{DRV}$. In a case in which a theoretical value is employed as the driving voltage $V_{DRV}$, the value of the audio signal S3 that corresponds to an instruction value for the driving voltage $V_{DRV}$ may be employed.

In the measurement of the impedance Z, a DC impedance may be measured in a state in which a DC driving voltage (reference signal) $V_{DRV}$ is applied. Alternatively, an AC impedance may be measured in a state in which an AC driving voltage $V_{DRV}$ having a predetermined frequency is applied.

The DSP 202 corrects the gain (or frequency characteristics) of the audio signal S3 based on the impedance thus measured.

Figure 4A:
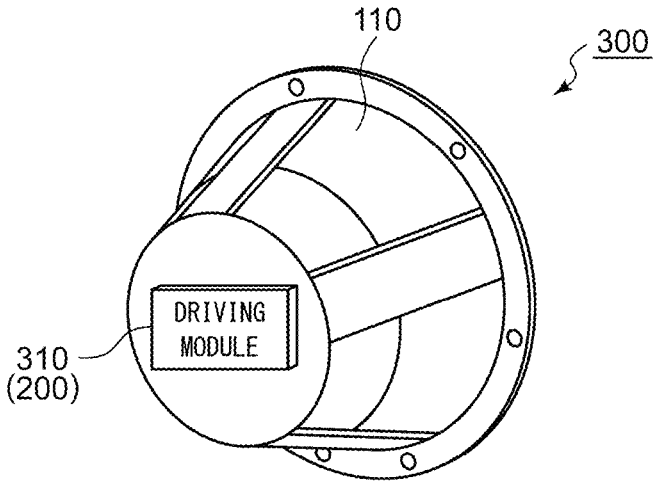
FIGS. 4A and 4B are diagrams each showing a speaker unit according to an embodiment.
Figure 4B:
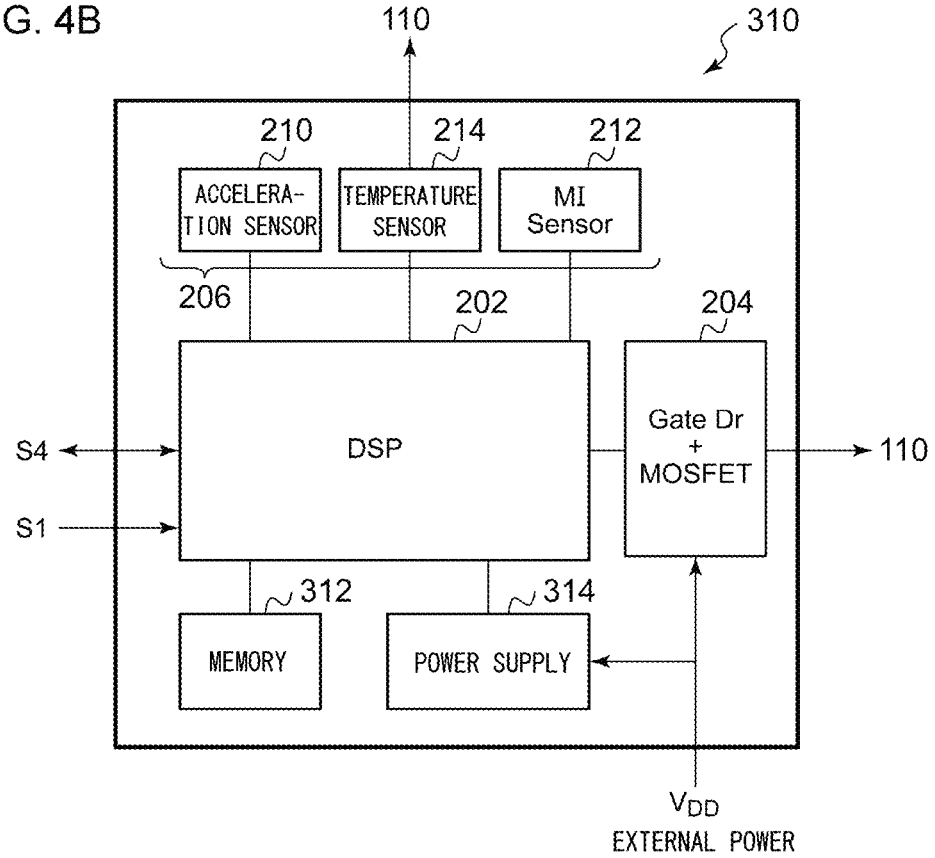

The above is an example configuration of the audio system 100. FIGS. 4A and 4B are diagrams showing a speaker unit 300 according to an embodiment. The speaker unit 300 is mainly employed in an in-vehicle audio system. FIG. 4A shows a configuration of the speaker unit 300. The speaker unit 300 includes the speaker 110 and a driving module 310 such that they are integrated as a single unit. The driving module 310 is configured such that the DSP 202, the amplifier 204, the sensor 206, and the like are mounted on a printed circuit board. The driving module 310 is mounted on the speaker 110.

FIG. 4B is a block diagram showing the driving module 310. The driving module 310 includes the DSP 202, the amplifier 204, the vibration sensor 210, the magnetic sensor 212, the temperature sensor 214, nonvolatile memory 312, and a power supply 314. The driving module 310 is monolithically integrated with the speaker 110. Accordingly, by mounting the vibration sensor 210 on the driving module 310, this arrangement allows the vibration sensor 210 to detect the vibration of the speaker 110. The magnetic sensor 212 is arranged at a position that allows it to detect the magnetic field $H_{MAGNET}$ that occurs due to the magnet 118 of the speaker 110.

The temperature sensor 214 is arranged at a position that allows it to detect the temperature of the speaker 110. In a case in which there is high thermal resistance between the speaker 110 and the driving module 310, and in a case in which there is a large difference in temperature between them, a sensing portion of the temperature sensor 214 (e.g., an electrode of a thermocouple or a thermistor) is preferably mounted directly on the speaker 110 instead of mounting it on the driving module 310.

The amplifier 204 is configured as a class D amplifier. The power supply voltage $V_{DD}$ for the amplifier 204 is supplied from an external power supply (e.g., in-vehicle battery). The power supply 314 stabilizes the power supply voltage $V_{DD}$ received from the external power supply to an appropriate voltage level, and supplies the stabilized voltage to the DSP 202 or the sensor 206.

The DSP 202 includes an interface for communicating with an unshown sound source (head unit). Specifically, the DSP 202 includes an interface for receiving a digital audio signal S1. For example, an S/PDIF (Sony Philips Digital Interface) or the like may be employed.

Furthermore, the DSP 202 includes an interface for receiving the control data S4 from the sound source. The control data S4 may include setting values for a digital volume control and an equalizer, and the data (correction gain) with respect to the above-described correction processing. As such an interface, an $I^2C$ (Inter IC) interface or an SPI (Serial Peripheral Interface) may be employed. As an in-vehicle interface, a CAN (Controller Area Network) or LIN (Local Interconnect Network) may be employed. The data that indicates the state of the speaker 110 acquired by the speaker unit 300 may be transmitted to the sound source via such an interface.

The nonvolatile memory 312 stores digital audio data. The audio data may include warning sound data, alarm sound data, voice message data, and the like. Upon receiving a reproduction instruction, which is control data, from the head unit, the DSP 202 reads out the corresponding audio data from the nonvolatile memory 312, and reproduces the audio data thus read out.

Figure 5:
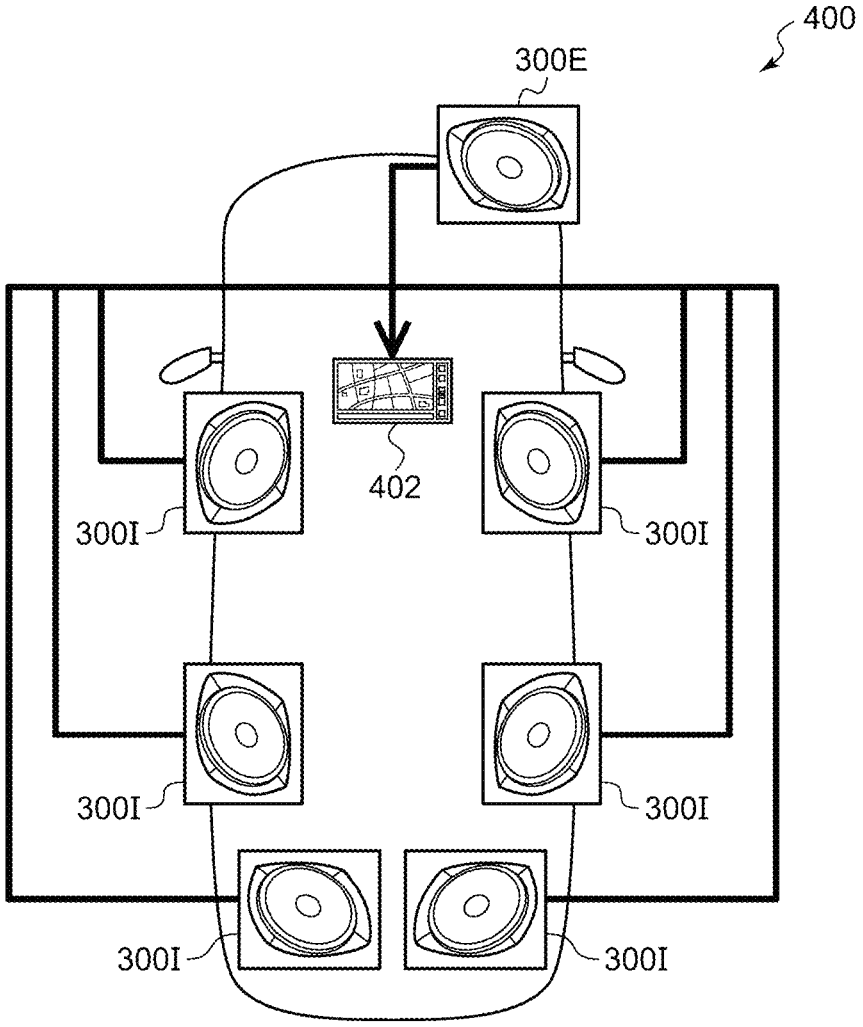
FIG. 5 is a diagram showing a vehicle including a speaker unit.

The above is the configuration of the speaker unit 300. Next, description will be made regarding the usage of the speaker unit 300. FIG. 5 is a diagram showing a vehicle 400 including the speaker unit 300. The vehicle 400 includes a head unit 402 that corresponds to the sound source and multipole speaker units 300. FIG. 5 shows an arrangement including six speaker units 300. However, the number of the speaker units 300 and the layout thereof are not restricted in particular.

One of the speaker units 300 (300E) may be arranged so as to emit a warning sound to the exterior of the vehicle 400. Electric vehicles and hybrid vehicles have an obligation to emit an audio signal generated so as to mimic an engine sound to a pedestrian or the like. By storing such an audio signal in the nonvolatile memory 312 of the speaker unit 300E, this arrangement provides such a function in a simple manner. In addition, the nonvolatile memory 312 may store horn sound data or the like.

For the speaker unit 300I installed within the interior of the vehicle, audio data such as turning signal sound data, announce sound data for driving in reverse, warning sound data for preventing drowsy driving, etc. may be stored.

The present disclosure includes the following technical ideas. When a difference occurs in a state (magnetic field, temperature, impedance) between multiple speakers 110, this can lead to a difference in the performance between them, resulting in a difference in the sound pressure between them. In order to solve such a problem, in the audio circuit 200 according to an embodiment, the DSP 202 may correct the audio signal such that the sound pressure becomes uniform between the speakers.

Furthermore, when a difference occurs in a state (magnetic field, temperature, impedance) between multiple speakers 110, this can lead to a difference in the frequency characteristics between them. In order to solve such a problem, the DSP 202 may correct the audio signal such that the frequency characteristics become uniform between the speakers 110.

The usage of the speaker unit 300 is not restricted to an in-vehicle system. Also, the speaker unit 300 is applicable to a home audio system, and particularly to a home theater system configured as a 5.1-channel, 7.1-channel system, or the like having a large number of channels.

While the preferred embodiments of the present invention have been described using specific terms, such description is for illustrative purposes only, and it is to be understood that changes and variations may be made without departing from the spirit or scope of the appended claims.

What is claimed is:

1. An audio circuit structured to drive a speaker, comprising:

a signal processing unit structured to correct an audio signal according to a state of the speaker;

an amplifier structured to drive the speaker according the corrected audio signal; and at least one sensor each structured to detect state of the speaker, wherein the at least one sensor includes a temperature sensor structured to detect a temperature of the speaker, and wherein the signal processing unit superimposes, on the audio signal, a correction signal having a low-frequency component (20 Hz or less) outside the audio band.

2. The audio circuit according to claim 1, wherein the at least one sensor includes a vibration sensor structured to detect a vibration of the speaker, and wherein the signal processing unit superimposes, on the audio signal, a signal having opposite phase to the vibration.

3. The audio circuit according to claim 1, wherein the at least one sensor includes a magnetic sensor structured to detect a magnetic field generated by the speaker.

4. The audio circuit according to claim 1, further comprising a detection circuit structured to measure a current that flows through the speaker, wherein the signal processing unit corrects the audio signal according to the temperature of the speaker.

5. The audio circuit according to claim 1, wherein a plurality of the speakers and a plurality of the audio circuits are used as a set, and wherein a correction for each audio circuit is controlled such that output characteristics become uniform between the plurality of speakers.

6. The audio circuit according to claim 1, wherein a plurality of the speakers and a plurality of the audio circuits are used in multi-channel audio system, and wherein each of the plurality of the audio circuits superimposes the correction signal on the audio signal when a difference between the temperature of the speaker of a corresponding channel and the temperature of the speaker of another channel exceeds a threshold.

7. A speaker unit comprising:

the speaker; and the audio circuit according to claim 1 structured to drive the speaker, wherein the speaker and the audio circuit are monolithically integrated.

8. The speaker unit according to claim 7, further comprising nonvolatile memory structured to store predetermined audio data, wherein the signal processing unit is capable of reproducing the audio data.

9. A vehicle comprising the speaker unit according to claim 8.

* * * * *